US006683026B2

(12) United States Patent
Storfer-Isser et al.

(10) Patent No.: US 6,683,026 B2
(45) Date of Patent: Jan. 27, 2004

(54) OPAQUE TRANSFER MATERIAL

(75) Inventors: Nathan I. Storfer-Isser, Liverpool, NY (US); James A. Nellis, Phelps, NY (US)

(73) Assignee: Felix Schoeller Technical Papers Inc., Pulaski, NY (US)

( * ) Notice: Subject to any disclaimer, the term of this patent is extended or adjusted under 35 U.S.C. 154(b) by 69 days.

(21) Appl. No.: 10/084,213

(22) Filed: Feb. 25, 2002

(65) Prior Publication Data

US 2003/0161974 A1 Aug. 28, 2003

(51) Int. Cl.[7] ..... B41M 5/20
(52) U.S. Cl. ..... 503/227
(58) Field of Search ..... 428/32.12, 32.24, 428/32.51, 32.5; 503/227

(56) References Cited

U.S. PATENT DOCUMENTS 6,042,914 A * 3/2000 Lubar ..... 428/41.4

* cited by examiner

*Primary Examiner*—Bruce H. Hess
(74) *Attorney, Agent, or Firm*—Amster, Rothstein & Ebenstein LLP

(57) ABSTRACT

A printable image transfer material comprising a siliconized support, an adhesive polymer containing layer applied on the support and an image receiving layer arranged on the polymer layer, said adhesive polymer containing layer being substantially free of pigment and cold-peelable from the siliconized support, said image receiving layer comprising solid particles, a binder mixture of a highly elastic, film forming first binder polymer and a second binder polymer or binder polymer mixture that comprises ethylene vinyl acetate and vinyl alcohol units.

7 Claims, No Drawings

OPAQUE TRANSFER MATERIAL

FIELD OF THE INVENTION

The invention relates to a cold peelable image transfer material for the transfer of images to fabrics.

BACKGROUND OF THE INVENTION

Transfer materials have been available for many years and serve the decoration of goods. Typically they consist of a polymeric or wax film which is formed on a support. An image is printed on the film and subsequently the film is transferred from the support to a substrate usually by applying pressure and/or heat to the back of the support.

FR 2 715 607 B1 describes a method for decorating a substrate with an image which, at first, has been printed on a transfer material. A digital image from a conventional video camera is printed using an ink-jet-printer onto the transfer material which comprises a plastic support and a heat-sensitive adhesive coating onto which the ink is printed. The printed side of the transfer material is placed in contact with the substrate and heat is applied to activate the support. The plastic support can be removed once the adhesion between the coating and the substrate is greater than that between the coating and the plastic support. FR 2 715 607 does not disclose the composition of the coating which accepts the printing ink. However, non-heat-sealable coatings are essentially continuous films deposited from a polymer solution in an organic solvent or water, or from a dispersion of a polymer in water with emulsifiers. WO 98/35840 describes a transfer film for transferring an ink comprising at least one liquid component, the film comprising a porous matrix of particles of a heat activatable adhesive bound together by an absorber, the absorber being at least partly soluble in the said liquid component within the porous matrix, and the absorber preferable being within the pores of the porous matrix. The absorber has the double function of binding the matrix of heat activatable adhesive and at least partially absorbing the liquid component of the ink.

The absorber is a water soluble or hydrophilic absorber, i.e. an acrylate copolymer, a cellulose ether and/or a polyvinyl pyrrolidone. However, the printed image on the transfer material of WO 98/35840 shows a grainy performance.

WO 98/02314 relates to a recording material for ink-jet printing, that comprises at least one temporary sheet-like material, a siliconized paper for example, and a porous recording layer which is arranged thereon and capable of being transformed into a film by the action of heat. Between the ink-recording layer and the substrate additional layers may be included such as an interface and an intermediate layer. On the intermediate layer which is a plastic film a partially hydrolyzed polyvinyl alcohol may be applied as an adhesive. After printing an image by ink-jet printing and forming a film the support is removed and the film transferred to a textile material.

One problem of the image transfer to textiles is that the image or the pigments which are present in the image layer tend to sink or to migrate into the textile material or adjacent layers arranged on the textile material. The decrease in pigment content in the image layer results in a decrease of the image quality. A further problem is that the polymers of the image layer penetrate into the textile material thereby reducing image quality. The sinking of image and polymers into the textile is particularly a problem when images are transferred to dark permanent supports due to the lack of contrast between the image and the background as compared with white fabrics.

SUMMARY OF THE INVENTION

It is an object of this invention to provide an improved image transfer material which does not show the above-mentioned disadvantages. The improved printable transfer material shall provide high color density, even image quality, in particular, on dark permanent carriers such as textile fabrics, good adhesion on the permanent carrier and high flexibility of the image bearing layer on the permanent carrier as well as durability of the image after multiple washings.

These and other objects are achieved with a laser printable image transfer material comprising a siliconized support, an adhesive polymer containing layer applied on the support and an image receiving layer arranged on the polymer layer, said adhesive polymer containing layer being substantially free of pigment and cold-peelable from the siliconized support, said image receiving layer comprising solid particles, a binder mixture of a high elastic, film forming first binder polymer and a second binder polymer or binder polymer mixture that comprises ethylene vinyl acetate and vinyl alcohol units.

Still further, the invention refers to a fabric onto which an image was transferred from the aforementioned laser printable image transfer material of the invention. The fabric can be any textile such as a shirt, sweat shirt, T-shirt or canvas bag.

Surprisingly, it was found that an excellent particle hold out on textile fabrics is achieved by the composition of the image layer. This means particles such as pigments are prevented from sinking into the fabric or adjacent layers. Without being bound to a certain theory it is assumed that low amounts of the polyvinyl alcohol being part of the binder polymer or being present in addition to such a binder polymer keep the image on the surface of the fabric in the image layer.

It was found that polyvinyl alcohol together with the first binder was not suited. The layer was too brittle and cracks readily. The water fastness of the product was also very poor. Many resins were examined but the desired hold out effect was only achieved by the teaching of the present invention.

DETAILED DESCRIPTION OF THE INVENTION

The adhesive polymer containing layer of the present invention is substantially free or completely free of pigments. This layer functions as a hot-melt adhesive layer. Its tackiness keeps the image layer on the textile fabric. The polymer layer is capable of being cold-peeled from the siliconized support. The 90° peel force required for the remove of the adhesive polymer layer from the support can be adjusted in the range of from 0.55 to 1.00 g/mm. The coating weight of the adhesive polymer containing layer may amount to 15 to 50 g/m$^2$, preferably about 20 to 35 g/m$^2$.

The polymer layer which can be applied directly on the support preferably comprises a thermoplastic resin that can be extruded onto the support. This resin may be a homo polymer or a copolymer. Preferably, this resin is a copolymer that consists essentially of a low density polyethylene (LDPE) and an ethylene acrylic acid (EAA). The LDPE content may amount to 75 to 97%, preferably 80 to 87% by weight. The EAA content may amount to 3 to 25%, preferably 9 to 20% by weight. According to a particular preferred embodiment of the invention this resin comprises about 80% by weight LDPE and about 20% by weight EAA. This copolymer may have a Vicat softening temperature in the range of 37 to 46° C., preferably 40 to 43° C.

The adhesive polymer containing layer may contain additional additives such as wetting agents, slip additives, anti-blocking agents, anti-static agents and denesting agents.

The image receiving layer includes at least two binders plus vinyl alcohol units. The first binder forms a highly flexibly film. The amount of this polymeric binder in the image receiving layer is from 30 to 45%, preferably from 33 to 40% by weight. The film forming first binder polymer is preferably an aliphatic polyester polyurethane. This polymer may be used as a dispersion. The first binder polymer should have a low vicat softening point according to ASTM D 1525-98. Preferably the Vicat softening point is less than 125° C., most preferably 55 to 65° C. determined according to ASTM D 1525-98. According to a further preferred embodiment of the invention the first binder polymer provides a film with an elongation at break of from 500 to 1,200, preferably greater than 1,000.

Preferably the second binder polymer is an ethylene vinyl acetate resin. This resin composition includes a small amount of polyvinyl alcohol units. A small amount of polyvinyl alcohol in the sense of the present invention means 0.1 to 3%, preferably 0.3 to 1% by weight based on the dry weight of the image receiving layer. Thus, the ethylene vinyl acetate resin can be designated a PVA shielded resin.

The amount of the second binder in the image receiving layer is preferably in the range of 20 to 30%, most preferably 23 to 28% by weight.

It is not necessary to add the PVA together with the second binder resin. PVA can also be part of the coating mass of the image receiving layer.

The image receiving layer comprises solid particles selected from a group consisting of organic pigments, inorganic pigments, glass beads, and mixtures thereof. A preferred inorganic pigment is titanium dioxide. The amount of solid particles in the image receiving layer is 20 to 40% by weight based on the weight of the dry layer.

Glass beads are preferably included in the image receiving layer to minimize a tackiness of the image receiving layer that may occur from a binder present therein. Their particle size is preferably in the range of 1 to 100 $\mu$m, most preferably 10 to 65 $\mu$m.

The image receiving layer can be applied to the support material from an aqueous coating solution. Any conventional application and dosing method can be used for this purpose. The application weight of the receiving layer may vary from 5 to 40 g/m$^2$, particularly 22 to 35 g/m$^2$. The coating solution may contain additives known in the art.

The support material is usually any flexible sheet material such as plastic films, uncoated or surface-modified papers, nonwoven and woven webs, foils and the like. The support material preferably is siliconized in order to improve its release from the other layers. As a support material any kind of raw paper may be used. Preferably surface sized papers, calendered or non-calendered papers or highly sized raw paper may be used. The raw paper may be sized with acidic or neutral sizing agents.

Any design can be printed on the surface of the image support material with the aid of various digital and analog printing processes including but not limited to laser printing, screen printing, lithographic printing and gravure printing. After imaging, the adhesive polymer containing layer and the image layer are stripped from the support without stretching or distorting the image and are applied to the permanent carrier. The transfer occurs under heat, for example 130 to 200° C., and pressure, for example $0.13\times10^4$ to $50.0\times10^4$ N/m$^2$.

The following examples serve to further explain the invention.

EXAMPLE 1

Onto a siliconized paper with a basis weight of 120 g/m$^2$ a copolymer of LDPE and ethylene acrylic acid was extruded. The coating weight of the extruded layer was 20 g/m$^2$. On samples of this said adhesive polymer containing layer two different image receiving layer for the laser printing process were applied. Coating mass (a) was an aqueous mixture of an aliphatic polyester polyurethane resin and a PVA shielded ethylene vinyl acetate resin. Coating mass (b) was an aqueous mixture of an aliphatic polyester resin and an ethylene vinyl acetate resin without PVA. Both ethylene vinyl acetate resins had the same solid content. The coating weight in each case was 35 g/m$^2$.

With a laser printer an image was printed on the printable image receiving material and transferred onto dark blue fabrics under the action of 375° F. and moderate pressure for ten seconds.

EXAMPLE 2

In the image transfer material of example 1 which includes the PVA shielded ethylene vinyl acetate resin the aliphatic polyester polyurethane resin was replaced by an ethylene acrylacetate resin. Printing and transfer on a dark blue fabric were performed as described in example 1.

The transfer materials of examples 1 and 2 were tested for their durability (washability), their capability to keep the image on the surface of the fabric and their opacity. The assessment of durability was performed by evaluating cracking and tearing of the image receiving layer after five wash cycles in warm water (40° C.) and five drying cycles at high heat (60° C.). Final determination of durability was made qualitatively by using a binary outcome(accept, reject).

The capability to keep the image on the front side, i.e. the hold out, by determination of the opacity of the image. Initial determination of opacity was made through observation of the transferred structure and then assigning a binary outcome (accept, reject) based on the show-through of the underlying fabric. From this exercise it was determined that the pre-transferred opacity must be greater than 80% as measured by an opacimeter (BNL-2 opacimeter, Technidyne Corporation).

Blocking was tested by placing several samples under an eight-pound weight at 50° C. for 48 hours. Subsequently, the samples were removed. If they separated without blocking they were accepted.

We claim:

1. A printable image transfer material comprising a siliconized support, an adhesive polymer containing layer applied on the support and an image receiving layer arranged on the polymer layer, said adhesive polymer containing layer being substantially free of pigment and cold-peelable from the siliconized support, said image receiving layer comprising solid particles, a binder mixture of a highly elastic, film forming first binder polymer and a second binder polymer or binder polymer mixture that comprises ethylene vinyl acetate and vinyl alcohol units.

2. The printable image transfer material according to claim 1 wherein the polymer of said adhesive polymer containing layer is selected of one or more polymers having a vicat softening point of from 35 to 45° C.

3. The printable image transfer material according to claim 1 wherein the polymer of said adhesive polymer containing layer is a low density polyethylene (LDPE)/ethylene acrylic acid (EAA) copolymer.

4. The printable image transfer material according to claim 1 wherein the first binder polymer of the image layer is a thermoplastic polymer having a Vicat softening point in the range of 40 to 43° C.

5. The printable image transfer material according to claim 4 wherein the thermoplastic polymer is an aliphatic polyester polyurethane resin.

6. The printable image transfer material according to claim 1 wherein the second binder polymer of the image receiving layer is a ethylene vinyl acetate shielded with polyvinyl alcohol.

7. The printable image transfer material according to claim 6 wherein the ethylene vinyl acetate shielded with polyvinyl alcohol includes 0.1 to 3% by weight alcohol based on dry weight of the image receiving layer.

* * * * *